US008256752B2

(12) United States Patent
Kilian et al.

(10) Patent No.: US 8,256,752 B2
(45) Date of Patent: Sep. 4, 2012

(54) REMOVING A PROCESSED PART

(75) Inventors: Friedrich Kilian, Leonberg/Gebersheim (DE); Frank Schmauder, Metzingen (DE); Rainer Kraemer, Renningen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 1106 days.

(21) Appl. No.: 12/145,688

(22) Filed: Jun. 25, 2008

(65) Prior Publication Data

US 2009/0035117 A1 Feb. 5, 2009

(30) Foreign Application Priority Data

Jun. 30, 2007 (EP) ..... 07012866

(51) Int. Cl.
*B23Q 7/08* (2006.01)

(52) U.S. Cl. ..... 269/14

(58) Field of Classification Search ..... 182/223; 187/337; 198/346.3, 359, 539, 540, 560, 198/561, 589, 772; 414/789; 269/13, 14
See application file for complete search history.

(56) References Cited

U.S. PATENT DOCUMENTS

| | | | | |
|---|---|---|---|---|
| 3,699,723 | A | 10/1972 | Wloszek | |
| 3,787,039 | A * | 1/1974 | Zeichman | 269/13 |
| 4,058,199 | A * | 11/1977 | Schlagel | 198/359 |
| 4,501,107 | A * | 2/1985 | Piotrowski | 53/438 |
| 5,072,797 | A * | 12/1991 | Hughes | 177/145 |
| 5,129,484 | A * | 7/1992 | Wagner | 187/244 |
| 5,285,719 | A * | 2/1994 | McFadden et al. | 99/476 |
| 5,355,575 | A * | 10/1994 | Self | 29/430 |
| 6,059,094 | A * | 5/2000 | Swanstrom et al. | 198/735.4 |
| 6,505,727 | B2 * | 1/2003 | Schroeder et al. | 198/359 |
| 6,736,297 | B2 * | 5/2004 | Kassian et al. | 222/561 |
| 7,222,714 | B2 * | 5/2007 | Lilly | 198/359 |
| 7,651,053 | B2 * | 1/2010 | Fort | 244/129.4 |
| 7,899,575 | B2 * | 3/2011 | Kilian et al. | 700/186 |
| 7,992,475 | B2 * | 8/2011 | Buettner | 83/25 |

(Continued)

FOREIGN PATENT DOCUMENTS

EP 2008735 A1 * 12/2008

(Continued)

OTHER PUBLICATIONS

European Search Report from corresponding European Patent Application No. 07 01 2866, mailed Nov. 23, 2007, 3 pages.

*Primary Examiner* — Lee D Wilson
*Assistant Examiner* — Jamal Daniel
(74) *Attorney, Agent, or Firm* — Fish & Richardson P.C.

(57) ABSTRACT

A machine tool is provided for processing a workpiece, e.g., a metal sheet. The machine tool comprises at least one support configured to, in a support position, support a part of the workpiece on an upper surface, the part being completely separated from the workpiece, and a motion unit for moving the support downwards out of the support position into a discharge position located underneath the support. The motion unit is configured to accelerate the support, at least in a region of the part lying thereon, out of the support position along a gravitational direction with an acceleration which is greater than an acceleration of the part in the gravitational direction, and to move the accelerated support into an open position located outside a path of movement of the part at a speed such that the workpiece part attains the discharge position in free fall.

24 Claims, 4 Drawing Sheets

U.S. PATENT DOCUMENTS

| | | | | |
|---|---|---|---|---|
| 2002/0121532 | A1* | 9/2002 | Kassian et al. | 222/561 |
| 2002/0152899 | A1* | 10/2002 | Young et al. | 99/357 |
| 2003/0066735 | A1* | 4/2003 | Sullivan, Jr. | 198/359 |
| 2006/0032981 | A1* | 2/2006 | Fort | 244/129.4 |
| 2008/0168876 | A1* | 7/2008 | Kilian et al. | 83/424 |
| 2008/0210516 | A1* | 9/2008 | Blaser et al. | 198/341.05 |
| 2009/0003952 | A1* | 1/2009 | Schmauder | 409/183 |
| 2009/0005898 | A1* | 1/2009 | Kilian et al. | 700/172 |
| 2009/0010731 | A1* | 1/2009 | Heusel | 409/199 |
| 2009/0015181 | A1* | 1/2009 | Schmauder | 318/135 |
| 2009/0035117 | A1* | 2/2009 | Kilian et al. | 414/728 |
| 2009/0107206 | A1* | 4/2009 | Thonig et al. | 72/405.09 |
| 2009/0127762 | A1* | 5/2009 | Kilian | 269/296 |
| 2009/0196969 | A1* | 8/2009 | Guzman | 426/419 |
| 2010/0132526 | A1* | 6/2010 | Wahl et al. | 83/152 |

FOREIGN PATENT DOCUMENTS

| | | | | |
|---|---|---|---|---|
| EP | 2008736 | A1 | * | 12/2008 |
| EP | 2008752 | A1 | * | 12/2008 |
| JP | 51146672 | A | | 12/1976 |
| JP | 61295967 | A | | 12/1986 |
| JP | 3104532 | A | | 5/1991 |
| JP | 5067312 | A | | 3/1993 |
| JP | 5161990 | A | | 6/1993 |
| JP | 7214359 | | | 8/1995 |
| JP | 10118879 | | | 5/1998 |
| JP | 10118879 | A | * | 5/1998 |
| JP | 2005112458 | A | | 4/2005 |
| JP | 2009012075 | A | * | 1/2009 |
| JP | 2009012076 | A | * | 1/2009 |
| JP | 2009012171 | A | * | 1/2009 |
| WO | WO 2007134627 | A1 | * | 11/2007 |
| WO | WO 2007134628 | A1 | * | 11/2007 |
| WO | WO 2007134630 | A1 | * | 11/2007 |
| WO | WO 2007134631 | A1 | * | 11/2007 |

* cited by examiner

REMOVING A PROCESSED PART

CROSS REFERENCE TO RELATED APPLICATION

This application claims priority under 35 U.S.C. §119(a) from EP Application No. 07 012 866.5, filed Jun. 30, 2007, the entire contents of which are hereby incorporated by reference.

TECHNICAL FIELD

This invention relates to processing a workpiece, and more particularly to moving a processed part of the workpiece into a discharge position.

BACKGROUND

During processing of a workpiece with a machine tool, for example, a laser cutting device or a punching device, the processed parts of the workpiece need to be removed to allow the processing of the next part. Exemplary mechanisms for removing a processed part are disclosed, for example, in the Japanese Patent publications JP 7214359 and JP 10118879.

SUMMARY

In one aspect, a machine tool for cutting a preferably plate-shaped workpiece, especially a metal sheet, includes at least one support, on the upper surface of which a workpiece part lies in a process position. The workpiece part has been completely cut out of the workpiece. The machine tool has a motion unit for moving the support downwards out of a support position in order to move the workpiece part into a discharge position located underneath the support.

The motion unit is further designed to accelerate the support, at least in the region of the workpiece part lying thereon, out of a support position in the gravitational direction with an acceleration which is greater than the acceleration of the workpiece part in the gravitational direction, and to move the accelerated support into an open position located outside the path of movement of the workpiece part at a speed such that the workpiece part attains the discharge position in free fall.

In some embodiments, the workpiece part moves into the discharge position in free fall. In relation to a gliding or sliding movement, a free-fall movement has the advantage that it usually represents the fastest possible way of moving the workpiece part into a discharge position outside the machining region. To allow a free-fall movement, the support can be accelerated downwards out of the support position more quickly than the workpiece part itself so that the latter is lifted from the support. Thereby, the reliability of the process can be increased because the workpiece part cannot be shifted laterally and can thus be prevented from being held back by the remainder of the workpiece. The support is subsequently moved out of the path of movement of the workpiece part into an open position typically located laterally thereof. Thereby, the workpiece part is prevented from striking the support after having been lifted therefrom and can attain the discharge position unimpeded.

In some embodiments, at least one, e.g., each support can be mounted so as to be pivotable about a rotation axis extending, for example, at a right angle to the gravitational direction. The support can then be horizontally orientated in the support position so that the workpiece part can lie on its upper surface. The support can be pivoted downwards about the rotation axis in order to move the workpiece part into the discharge position. To allow free fall of the workpiece part, the supporting region of the workpiece part can be arranged eccentrically to the rotation axis so that when the support is pivoted about the rotation axis, the support can be accelerated with a greater acceleration than the workpiece part itself. The acceleration of the support out of the support position in the gravitational direction can increase with the distance from the rotation axis, so that the greater the distance of the supporting region from the rotation axis, the smaller the torque can be chosen for accelerating the support.

In some embodiments, at least one, e.g. each support, can be motionally coupled to the motion unit via a connecting piece which acts on the support eccentrically to its rotation axis. Then, the motion unit does not act directly on the rotation axis of the support. A lever effect can be produced by the connecting piece, and the synchronous pivoting of a plurality of supports can be facilitated, as will be described below.

In some embodiments, the motion unit can have at least one guide which is displaceably guided in the gravitational direction and on which the connecting pieces are displaceably guided in a linear manner preferably at right angles to the gravitational direction. By moving the guide in the gravitational direction by means of a common drive, the connecting pieces and with them the supports can be synchronously pivoted. The connecting pieces can be positively guided on the guide and can be displaced along the guide, e.g., in a horizontal direction, during the displacement of the guide in the gravitational direction.

In some embodiments, the connecting pieces can be rotatably mounted on the supports and non-rotatably mounted on the common guide. During the pivoting movement of the supports, this can permit parallel displacement of the connecting pieces, but does not permit rotational movement.

In some embodiments, a slide can be provided on at least one of the connecting pieces and projects into the path of movement of the free-falling workpiece part at least in the open position of the support. Then, during the pivoting movement of the support, the slide can be moved downwards and laterally, whereby the slide can project into the path of movement in the open position of the support without additional aids. The provision of the slide can be advantageous, for example, when a constructional unit such as a suction tube is mounted within an area of the path of movement because, the unit can be covered by the slide in order to prevent the workpiece part from striking the constructional unit.

In some embodiments, a fixed slide can be provided for removing the workpiece part from the discharge position. The fixed slide can adjoin the slide mounted on the connecting piece and the two together can delimit the path of movement of the workpiece part downwards, and, e.g., determine the discharge position that the workpiece part attains in free fall.

In some embodiments, the or, e.g., each support can be lowered in the gravitational direction in a linear movement for acceleration out of the support position, wherein the linear movement can be preferably effected over a distance of at most 5 mm, in particular at most 2 mm. For acceleration of the support, the latter can be first displaced in a parallel manner in the gravitational direction, whereby the workpiece part is lifted from the support. The support can subsequently be moved out of the path of movement of the workpiece part in the gravitational direction in a variety of ways, e.g., by displacing the support at right angles to the gravitational direction. The linear movement can further be followed by the above-described pivoting movement of the support about a rotation axis to move the support into the open position.

In some embodiments, the or, e.g., each support in the support position can be biased in the gravitational direction by a biasing means. Great acceleration out of the support position can be generated by the bias. The bias can be produced by applying a force counter to the gravitational direction. The force pushes the supports upwards against a spring force or hydraulic force acting in the gravitational direction.

In some embodiments, the motion unit can have a common drive for synchronously pivoting the supports and, e.g., for synchronously moving the supports during the linear movement. By means of the synchronous pivoting movement, it is possible to prevent a transverse force being exerted on the workpiece part due to the workpiece part being lifted more quickly from one of the supports than from the other during acceleration of the workpiece part out of the support position. Furthermore, costs can be saved by using a common drive for both the pivoting and the linear movement.

In some embodiments, the motion unit can be designed to accelerate the or, e.g., each support in the gravitational direction with an acceleration which is greater than the acceleration due to gravity and is preferably at least twice, in particular at least three times the acceleration due to gravity. A force acting in the gravitational direction in addition to the gravitational force is usually not exerted on the workpiece part in the support position, so that the workpiece part can be accelerated out of the process position with the acceleration due to gravity. However, the support should then be accelerated with a higher acceleration in order to lift the workpiece part from the support. It can be advantageous that a high acceleration acts on the support at least during the first phase of movement because then the support can subsequently be removed from the path of movement of the workpiece part at a lower speed.

In some embodiments, two supports can be provided which are mounted on opposite sides so as to be pivotable about preferably parallel, spaced rotation axes. The falling distance of the workpiece part from the support position to the discharge position can be at least about the width of the support perpendicularly to the rotation axis because the support can usually be pivoted through 80° or more in order to attain the open position located outside the path of movement. The width of the workpiece parts that can be moved into the discharge position is limited by the width of the support. By providing two opposing supports, the width of the workpiece parts that can be moved into the discharge position can be increased without also increasing the falling distance and accordingly the falling time.

In some embodiments, a suction opening can be provided in the support for the removal, by suction, of gases which are produced during the cutting process and/or of waste material. The suction opening can usually be arranged in a machining position of the machine tool, e.g. underneath a laser machining head, and can serve to remove waste material and gases generated during the laser machining of the workpiece. The suction opening can usually be connected to a suction arrangement via a suction tube arranged below the support. When the support is moved into the open position, the suction tube may be in the way and can therefore be moved downwards, e.g., by means of the above-described drive. The slide fixed to the connecting piece can further be dimensioned to cover the opening of the suction tube when the support is in the open position.

In some embodiments, at least one sensor, e.g. at least one light barrier, can be provided for detecting when the workpiece part has attained the discharge position. As soon as the attainment of the discharge position has been detected, the support or the supports can be moved back from the open position into the support position and the machining of the workpiece can be continued. The idle time of the machine tool can thereby be reduced and the reliability of the process can be simultaneously increased when, in the absence of the detection signal, an error signal is generated such that, e.g. further machining is temporarily stopped in order to avoid damage. A series of light barriers can be used which can arranged side by side and form a light grid for monitoring a two-dimensional area at the discharge position.

In some embodiments, the support can in the support position at least partly close an opening in a machining table of the machine tool. For example, the support can be horizontally orientated in the support position and can be arranged at the level of the machining table. However, the support position can optionally also be defined at a position lower than the surrounding machining table, e.g., if the support with the workpiece part lying on its upper surface is initially to be slowly lowered.

In some embodiments, at least one support can be fixed to a displacement arrangement for displacing the support along the machining table. Then, at least one of the supports lying opposite the movable support can be mounted on the machining table. By means of the displacement arrangement, the movable support can be moved away from the other support, e.g., out of a position in which the movable support is adjacent to the other support and in which it closes the opening in the machining table together with the other support. Thereby, a gap can be formed between the supports. Then workpiece parts, which have a greater width in the displacement direction than the sum of the widths of the two supports, can be moved into the discharge position. In this case, the movable support can be displaced until the opposing ends of the workpiece part rest only on the two supports and not on the machining table. As soon as the displaceable support has reached such a position, the supports can be accelerated out of the support position as described herein.

In another aspect, a method of moving a workpiece part, which has been completely cut out of a preferably plate-shaped workpiece, especially a metal sheet, from a support position, in which the workpiece part lies on the upper surface of a support located in a support position, into a discharge position located underneath the support includes accelerating the support, at least in the region of the workpiece part lying thereon, out of the support position in the gravitational direction with an acceleration which is greater than an acceleration of the workpiece part in the gravitational direction, and moving the accelerated support into an open position located outside the path of movement of the workpiece part at a speed such that the workpiece part attains the discharge position in free fall. The method can enable the workpiece part to be moved into the discharge position quickly and reliably.

The or, e.g., each support can be preferably lowered in the gravitational direction in a linear movement for acceleration out of the support position, wherein the linear movement can be effected over a distance of, e.g., at most 5 mm, in particular at most 2 mm. Owing to the linear movement, workpiece parts, which are arranged on the upper surface of the support in the vicinity of the rotation axis, can also be lifted from the upper surface of the support, which would require very high acceleration in the case of pure rotational movement.

In some embodiments, one, or, e.g., each support can be pivoted about a rotation axis preferably extending at right angles to the gravitational direction to accelerate the support at least within the region of the workpiece part lying thereon and/or to move the accelerated support into an open position located outside the path of movement of the workpiece part. Further, one can combine a linear movement, during which the workpiece part is lifted from the support, and a subsequent rotational movement for moving the support out of the path of movement of the workpiece part.

In addition, the aforementioned features and the features mentioned herein below can be employed individually or jointly in any combination.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference symbols in the various drawings indicate like elements.

DETAILED DESCRIPTION

Figure 1:
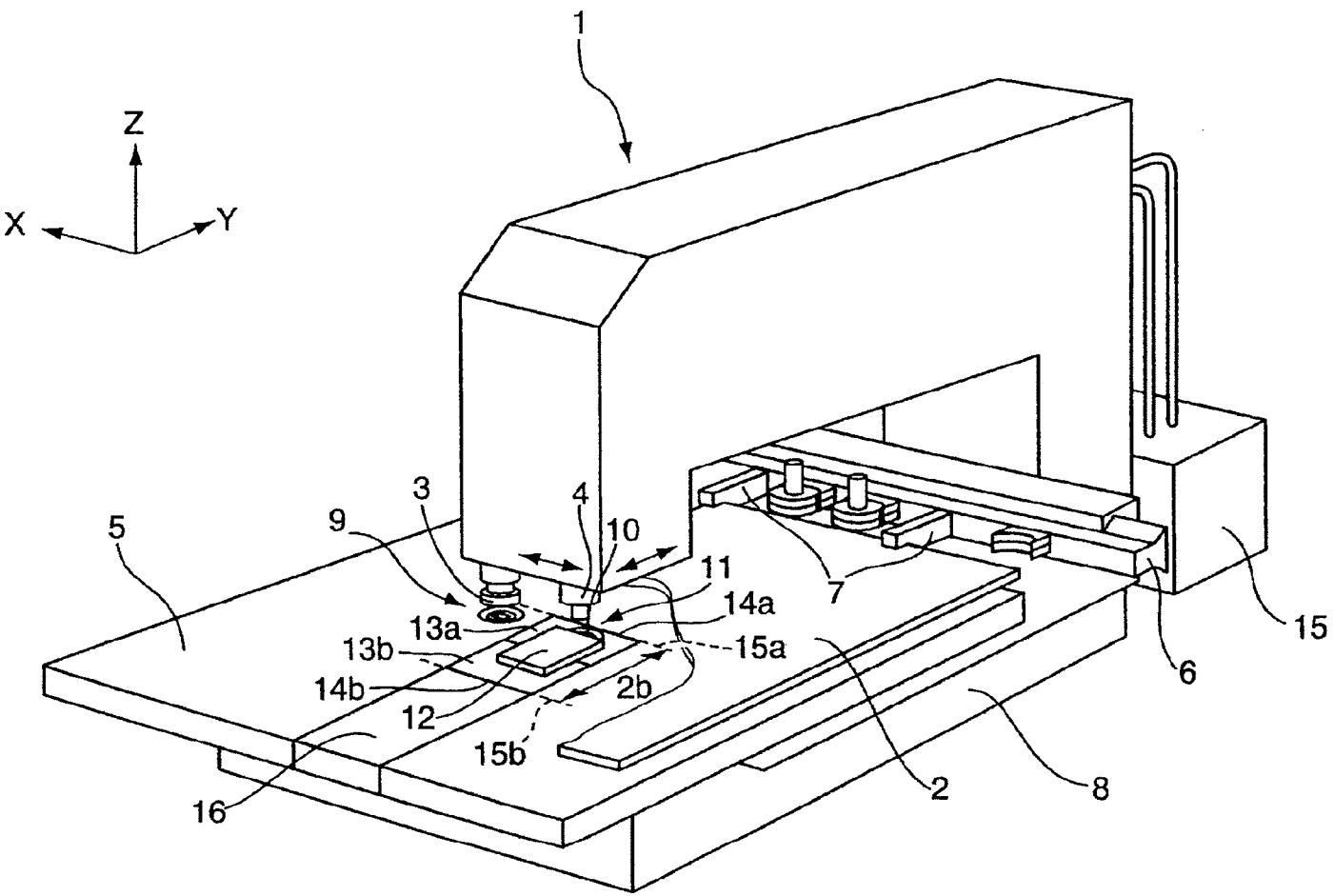
FIG. 1 is a schematic illustration of a machine tool with two supports.

FIG. 1 shows a machine tool 1, in particular, a laser punching press, with a conventional punching device 3 and a laser machining head 4 as tools for machining a workpiece 2, e.g. a metal sheet. During machining, the workpiece 2 lies on a machining table 5. With a conventional holding arrangement 6 with clamps 7 for securing the workpiece 2, the workpiece 2 can be displaced relative to the fixed punching device 3 and the laser machining head 4 in an X direction that lies within the plane of the metal sheet, which defines an X-Y plane of an XYZ co-ordinate system as indicated in FIG. 1. By means of a conventional coordinate guide (not shown), the machining table 5 is mounted on a base 8 such that the workpiece 2 can be moved in a Y direction within the plane of the metal sheet by moving the machining table 5 and the holding arrangement 6 together relative to the base 8.

Accordingly, the workpiece 2 can be displaced relative to the punching device 3 and the laser machining head 4 in the X and Y directions and respective region of the workpiece 2 can be moved into a spatially fixed machining region 9 of the punching device 3 or into a machining region 11 of the laser machining head 4. The machining region 11 is confined by a substantially circular suction opening 10 in the machining table 5. The suction opening 10 serves to remove, by suction, waste material and gases, which are produced during machining of the workpiece with the laser machining head 4. An area of the workpiece table 5 in the X direction, on which the machining regions 9, 11 are formed, is fixed and is not displaced in relation to the base 8 in the Y direction, so that the suction opening 10 is always positioned underneath the laser machining head 4.

After a region of the workpiece 2 to be machined has been moved into the machining region 11, the laser machining head 4 is activated to cut an, e.g., rectangular workpiece part 12 completely out of the workpiece 2.

The cut out workpiece part 12 rests in the plane of the metal sheet on a first support 13*a* and a second adjacent support 13*b*, which are positioned in the plane of the metal sheet and are configured as flaps. The first support 13*a* is arranged directly below the laser machining head 4 and includes the suction opening 10 that defines the machining region 11.

To move the workpiece part 12 out of the plane of the metal sheet into a discharge position (not shown) located underneath the plane of the metal sheet, the supports 13*a*, 13*b* can be pivoted about two parallel rotation axes 15*a*, 15*b* on opposite sides 14*a*, 14*b*. In FIG. 1, the rotation axes 15*a*, 15*b* are spaced apart by a spacing, which corresponds to twice the width (2*b*) of the two supports 13*a*, 13*b* in the Y direction. Workpiece parts with a greater dimension in the Y direction than that spacing cannot be moved into the discharge position when the supports 13*a*, 13*b* are configured as shown in FIG. 1.

To enable larger workpiece parts also to be moved into the discharge position, the second support 13*b* is mounted to a displacement arrangement 16 that is configured as a displacement table and can be displaced together with the displacement arrangement in the Y direction within the plane of the metal sheet. The spacing between the two rotation axes 15*a*, 15*b* thereby increases in the Y direction, and an opening (not shown) is formed in the machining table 5 between the two supports 13*a*, 13*b*. The second support 13*b* is displaced until the opposing ends of the workpiece part rest only on the upper surfaces of the two supports 13*a*, 13*b* and not on the workpiece table 5 itself.

Figure 2A:
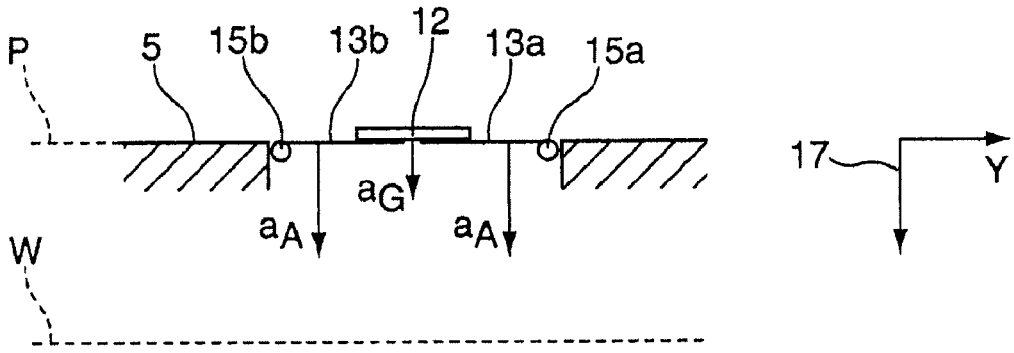
FIG. 2*a* is a schematic cross-section of a displacement region of a support table with two supports in a support position.
Figure 2B:
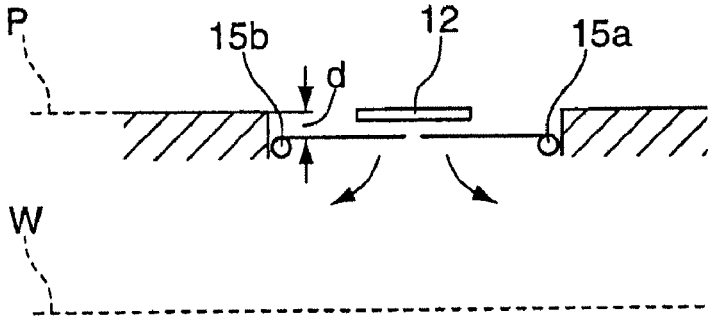
FIG. 2*b* is a schematic cross-section of the support table of FIG. 2*a* with the two supports in an intermediate position.

The movement of the workpiece part 12 from a process position P into a discharge position W lying there below will be further described in the following with reference to FIGS. 2*a-c*, which schematically show sequential steps of the movement of the supports 13*a*, 13*b* during this process. The spacing between the first support 13*a* and the second supports 13*b* in the Y direction is as shown in FIG. 1. In FIG. 2*a*, the supports 13*a*, 13*b* are located in a support position S in the plane of the machining table 5. In FIG. 2*b*, the supports 13*a*, 13*b* are in an intermediate position I and in FIG. 2*c*, the supports are in an open position O.

In FIG. 2*a*, the workpiece part 12 lies on upper surfaces of the supports 13*a*, 13*b*. To move the workpiece part 12 into the discharge position W in free fall, the two supports 13*a*, 13*b* are accelerated downwards in a linear manner from the support position S with an acceleration $a_A$ in the gravitational direction 17, which corresponds to the negative Z direction. The acceleration $a_A$ is about three times the acceleration due to gravity $a_G$ that acts on the workpiece part 12. Owing to the linear movement of the supports 13*a*, 13*b* downwards over a distance d of approximately 3 mm, the workpiece 12 is lifted from the supports 13*a*, 13*b*, as shown in FIG. 2*b*. The two supports 13*a*, 13*b* are subsequently pivoted about their respective rotation axes 15*a*, 15*b*, as indicated by arrows 16 in FIG. 2*b*, and are thereby moved into the open position O located outside the path of movement 18 of the workpiece part 12, as shown in FIG. 2*c*. Thus, the workpiece part 12 can free-fall into its discharge position W from which the workpiece part 12 can subsequently be discharged from the machine tool 1.

As an alternative to the above-described movement of the supports 13*a*, 13*b*, which is a combination of a linear movement and a pivoting movement, the same result can also be achieved by only pivoting the supports 13*a*, 13*b*. In this case, however, the acceleration, which is required to separate the workpiece part 12 from the supports 13*a*, 13*b* without it sliding along the supports 13*a*, 13*b*, is dependent upon the distance of the workpiece part 12 from the respective rotation axes 15*a*, 15*b*. The smaller the distance of the workpiece part 12 from the rotation axes 15*a*, 15*b*, the greater the acceleration must be during the pivoting movement.

As a further alternative to the sequence of movements described in connection with FIG. 2, the workpiece part 12, which initially lies on the upper surface of the supports 13*a*, 13*b*, can be moved by means of a linear movement over a distance of e.g. a few millimeters into a position located underneath the plane of the metal sheet in order to prevent the workpiece part from catching on the remainder of the workpiece (not shown). The above-described sequence of movements can then be carried out starting from this lowered position. As an alternative to the pivoting movement of the supports 13*a*, 13*b*, the supports 13*a*, 13*b* can also be moved out of the path of movement 18 of the workpiece part 12 in a different manner, e.g., in a linear movement at right angles to the gravitational direction 17.

How the sequence of movements described in FIGS. 2*a-c* can be implemented from a constructional point of view is described with reference to FIGS. 3*a, b* and FIG. 4, which each show detailed views of a lower part of the machine tool of FIG. 1. To provide the movement of the supports, the machine tool 1 is provided with a motion unit, shown in FIG. 3*a*. The motion unit includes, an electric motor serving as a drive 19 which is motionally coupled via a toothed belt 20 to a threaded spindle 22. The spindle 22 is guided in an overload-protected bearing 21. The threaded spindle 22 of the motion unit has a spindle nut 23, which can be moved in and counter to the gravitational direction 17. The spindle nut 23 is fixed to a guide 24. The guide 24 itself is guided in a linear manner within a longitudinal plate 25 and can be displaced in and counter to the gravitational direction 17.

Figure 3A:
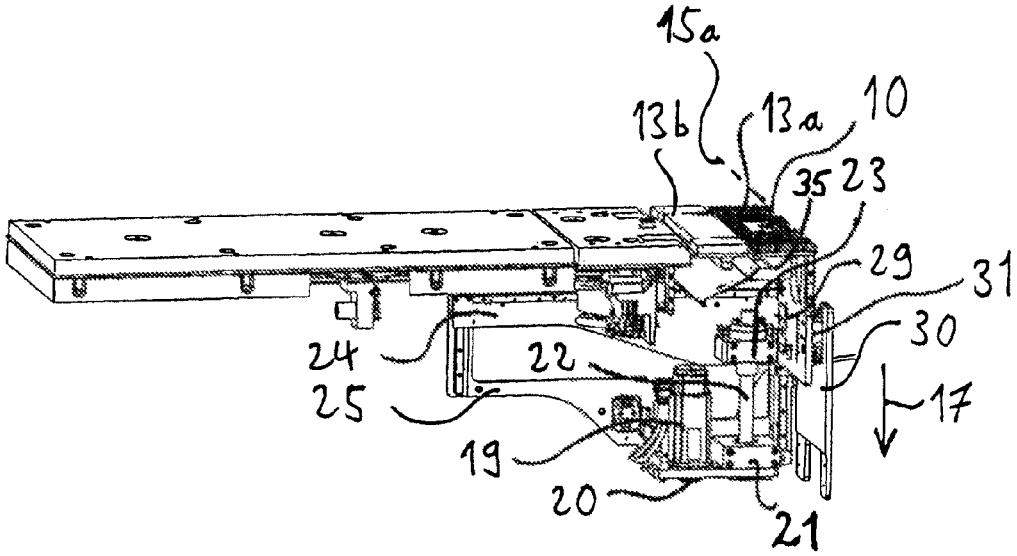
FIG. 3*a* is a perspective view of a section of the machine tool of FIG. 1 with the two supports in a support position.
Figure 3B:
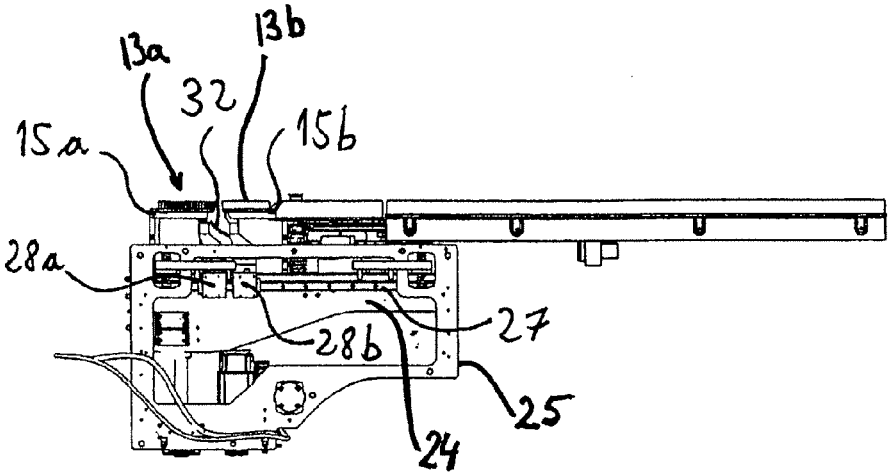
FIG. 3*b* is a view of the back side of the section of FIG. 3*a*.

As shown in FIG. 3*b*, the guide 24 includes a guide rail 27, which extends horizontally. The guide rail 27 guides two connecting pieces 28*a*, 28*b* to be linearly displaceable. The connecting pieces 28*a*, 28*b* each act upon one of the supports 13*a*, 13*b* eccentrically to the rotation axes 15*a*, 15*b*. The connecting pieces 28*a*, 28*b* are rotatably mounted on the supports 13*a*, 13*b*, whereas they are non-rotatably guided along the guide rail 27. If the drive 19 moves the spindle nut 23 downwards, the guide 24 is lowered and the connecting pieces 28*a*, 28*b* move downwards as well guided by the guide rail 27. During the downward movement, the connecting pieces 28*a*, 28*b* are simultaneously displaced horizontally along the guide rail 27 as a result of their non-rotatable mounting. As to the connecting pieces 28*a*, 28*b* act eccentrically to the rotation axes 15*a*, 15*b* onto the supports 13*a*, 13*b*, the supports 13*a*, 13*b* are pivoted downwards out of their horizontal position during this movement.

Figure 2C:
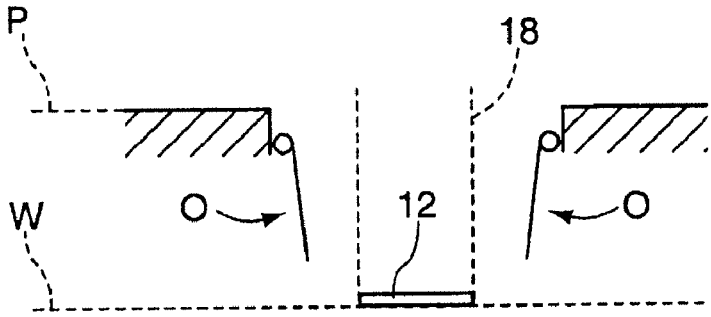
FIG. 2*c* is a schematic cross-section of a support table of FIG. 2*a* with the two supports in a discharge position.

To provide in addition to the pivoting movement a linear movement as shown in the first part of the sequence of movements of FIGS. 2*a-c*, the rotation axes 15*a*, 15*b* can be moved in or counter to the gravitational direction 17. This can be achieved by moving the connecting pieces 28*a*, 28*b* further upwards than would be necessary for a horizontal orientation of the supports 13*a*, 13*b*. Then, the supports 13*a*, 13*b* are pressed against a stop (not shown), which prevents an upwards pivoting movement of the supports 13*a*, 13*b* out of the horizontal orientation. During this process, a force is exerted on the supports 13*a*, 13*b* and thus also on the bearings of the rotation axes 15*a*, 15*b*.

As shown in FIG. 3*a*, the rotation axis 15*a* is rotatably mounted on a supporting plate 29 extending vertically, i.e., in the gravitational direction 17. The supporting plate 29 is guided on a further plate 30—likewise extending in the gravitational direction 17—of a transverse frame (not shown). When applying a force counter to the gravitational direction 17, the supporting plate 29 can be biased by a stop unit 31, which includes a spring unit (not shown) acting as a shock absorber and a hydraulic piston (not shown). The force applied counter to the gravitational direction 17 through the connecting pieces 28*a*, 28*b* pushes the supporting plate 29 and the bearing of the rotation axis 15*a* upwards against the spring or hydraulic force acting in the gravitational direction 17, typically with a stroke of approximately 3-5 mm.

If the drive 19 moves the connecting pieces 28*a*, 28*b* downwards, the rotation axes 15*a*, 15*b* also move downwards synchronously therewith as a result of the bias. Accordingly, the supports 13*a*, 13*b* execute a linear movement parallel to the plane of the metal sheet over the distance of the bias. If the connecting pieces 28*a*, 28*b* are moved further downwards, the above-described pivoting movement of the supports 13*a*, 13*b* immediately follows the linear movement. The speed of the pivoting movement is adapted to the preceding linear movement so that the workpiece part can no longer strike the supports 13*a*, 13*b* after having been lifted thereof.

Figure 4:
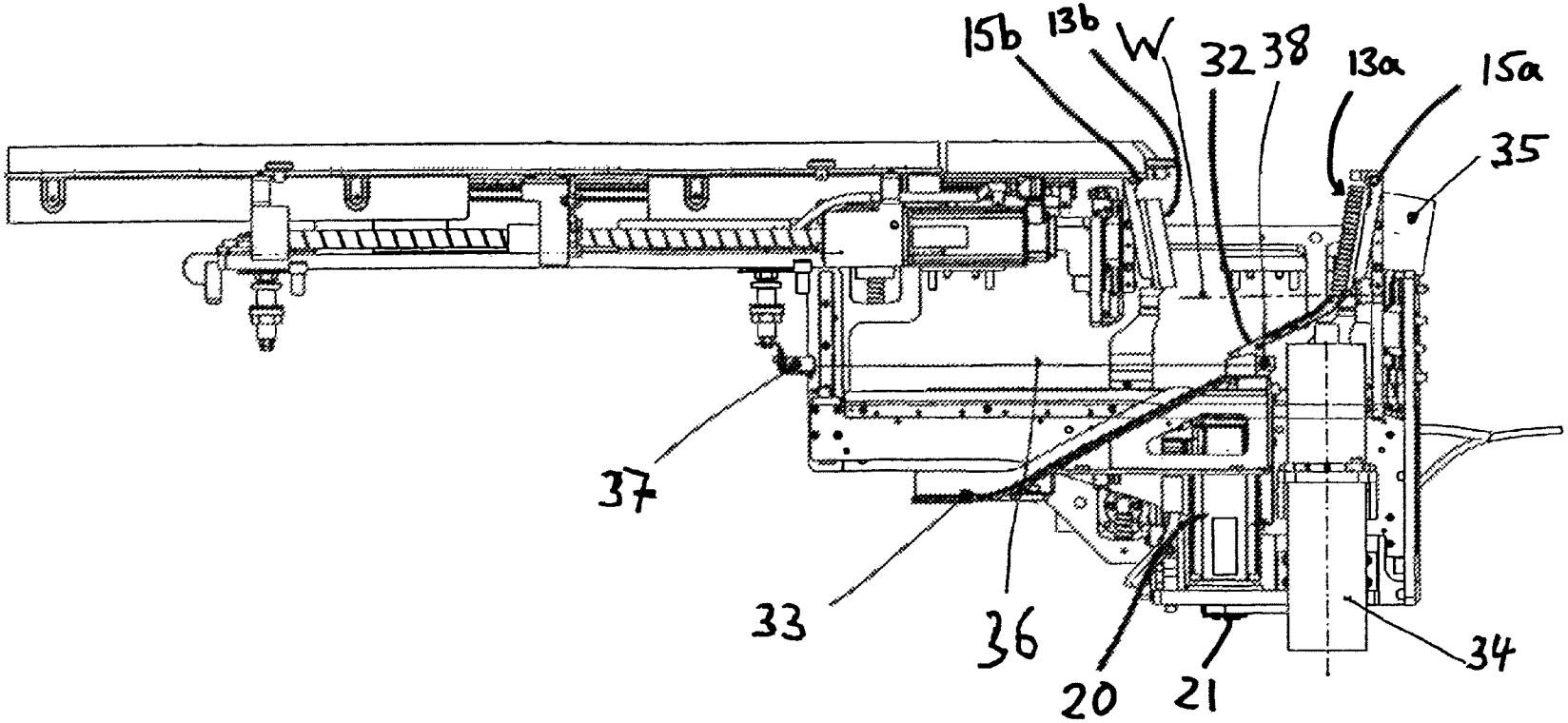
FIG. 4 is a side view of the section of FIG. 3*a* including additional elements and having the two supports in an open position.

FIG. 4 shows the supports 13*a*, 13*b* after termination of the above-mentioned movement into the open position. The supports 13*a*, 13*b* have been fully pivoted and form an angle of approximately 80° with the plane of the metal sheet. To discharge a workpiece part from the working region of the machine tool 1 after the free-falling movement as shown in FIGS. 2*a-c*, a movable slide 32 is mounted on the first connecting piece 28*a*, as can also be seen in FIG. 3*b*. The parallel displacement of the connecting piece 28*a* moves the movable slide 32 downwards. In the open position of the supports 13*a*, 13*b*, the movable slide 32 projects into the path of movement (not shown) of the workpiece part. In the open position of the supports 13*a*, 13*b*, a fixed slide 33 directly adjoins the movable slide 32. In its discharge position, a free-falling workpiece part therefore strikes either the fixed slide 33 or the movable slide 32 and can be discharged from the working region of the machine tool 1 in a sliding movement.

The movable slide 32, which is provided in addition to the fixed slide 33, additionally can cover a suction tube 34, which, in the support position S of the supports 13*a*, 13*b*, is in fluid connection with the suction opening 10 of the first support 13*a*. As shown in FIG. 3*a*, the suction tube 34 is fixed to the spindle nut 23 and is moved downwards during the displacement of the latter in the gravitational direction 17. An end piece 35 of the suction tube 34 is mounted to the first support 13*a* and is pivoted therewith, as shown in FIG. 4. A beam dump (not shown) is provided at a lower end of the suction tube 34 to absorb the laser beam passing through the suction opening 10 during laser operation.

A light grid 36 detects when a workpiece part has attained the discharge position and is formed by a series of light barriers in a horizontal direction at the height of the transition between the fixed slide 33 and the movable slide 32. The light barriers each comprise a light source 37 and an associated sensor 38. The discharge position, at which the workpiece part strikes the slides 32, 33 in free fall, depends on the dimensioning of the workpiece part. For example, the workpiece part can initially fully strike the movable slide 32 and pass the light grating 36 when it slides down onto the fixed slide 33.

The supports 13*a*, 13*b* should be moved back into the supporting position as soon as possible after the workpiece part has been detected in the discharge position to resume machining of the workpiece as quickly as possible. However, the arrangement of the light grid 36 underneath the movable slide 32 can prevent the support 13*a* from being pivoted upwards too soon and thereby possibly taking with it a workpiece part still partly lying thereon.

A number of embodiments of the invention have been described. Nevertheless, it will be understood that various modifications may be made without departing from the spirit and scope of the invention. For example, the above-described sequence of movements can be employed not only for the removal of workpiece parts from the machining region 11 of the laser machining head 4, but also for the removal of workpiece parts from the machining region 9 of the punching device 3. Furthermore, removal in the above-described manner can also be applied in other machine tools. For example, in punching/bending machines, the workpiece parts, having been cut out, and/or processed further in a bending operation, can be moved from the process position into the discharge position.

Accordingly, other embodiments are within the scope of the following claims.

What is claimed is:

1. A machine tool for processing a metal sheet, the machine tool comprising:

at least one support configured to, in a support position, support a part of the metal sheet on an upper surface, the part being completely separated from the metal sheet; and a motion unit, for moving the support downwards out of the support position into a discharge position, located underneath the support, wherein the motion unit is configured to accelerate the support, at least in a region of the metal sheet part lying thereon, out of the support position along a gravitational direction with an acceleration which is greater than an acceleration of the metal sheet part in the gravitational direction, and to move the accelerated support into an open position located outside a path of movement of the metal sheet part at a speed such that the metal sheet part attains the discharge position in free fall.

2. The machine tool according to claim 1, wherein the at least one support is pivotably mounted about a rotation axis.

3. The machine tool according to claim 2, wherein the at least one support is motionally coupled to the motion unit via a connecting piece, which acts on the support eccentrically to its rotation axis.

4. The machine tool according to claim 3, wherein the motion unit includes a guide and the motion unit is configured to provide displaceably guiding of the guide in the gravitational direction and to provide the connecting piece to be guided for linear displacement.

5. The machine tool according to claim 4, wherein the linear displacement is configured to be at a right angle to the gravitational direction.

6. The machine tool according to claim 4, wherein the connecting piece is rotatably mounted on the at least one support and is non-rotatably mounted on the guide.

7. The machine tool according to claim 3, further comprising a movable slide connected to the connecting piece and projecting into a path of movement of the free-falling metal sheet part in the open position of the support.

8. The machine tool according to claim 1, further comprising a fixed slide for removing the metal sheet part from the discharge position.

9. The machine tool according to claim 1, the machine tool further configured to lower the at least one support in the gravitational direction in a linear movement for acceleration out of the support position.

10. The machine tool according to claim 1, further comprising a biasing means configured to bias the at least one support in the support position in the gravitational direction.

11. The machine tool according to claim 1, wherein the motion unit includes a common drive for synchronously pivoting the at least one support and at least one further support.

12. The machine tool according to claim 11, wherein the common drive is further configured for synchronously moving the supports during a linear movement.

13. The machine tool according to claim 1, wherein the motion unit is configured to accelerate the at least one support in the gravitational direction with an acceleration, which is greater than the acceleration due to gravity.

14. The machine tool according to claim 1, wherein the at least one support includes two supports that are mounted on opposite sides of a retracting area defined by the two supports.

15. The machine tool according to claim 14, wherein the two supports are mounted to be pivotable about parallel and spaced rotation axes.

16. The machine tool according to claim 1, further comprising a suction opening in the at least one support for the removal, by suction, of waste material and/or of gases, which are produced during the cutting process.

17. The machine tool according to claim 1, further comprising at least one sensor for detecting when the metal sheet part has attained the discharge position.

18. The machine tool according to claim 1, further comprising a machining table, and wherein the at least one support is configured to close in its support position at least partly an opening in a machining table.

19. The machine tool according to claim 18, wherein the at least one support includes a support that is fixed to a displacement arrangement for displacing the support along the machining table.

20. The machine tool according to claim 1, wherein the rotation axis extends at right angle to the gravitational direction.

21. A method of moving a metal sheet part from a process position, in which the metal sheet part lies on an upper surface of at least one support, into a discharge position located underneath the at least one support, the method comprising:

accelerating the at least one support, at least in the region of the metal sheet part lying thereon, out of a support position in a gravitational direction with an acceleration that is greater than a gravitational acceleration of the metal sheet part; and moving the accelerated support into an open position located outside a path of movement of the metal sheet part at a speed such that the metal sheet part attains a discharge position in free fall.

22. The method according to claim 21, wherein the at least one support is lowered in the gravitational direction in a linear movement for acceleration out of the support position.

23. The method according to claim 21, wherein the at least one support is pivoted about a rotation axis to accelerate the at least one support at least in the region of the metal sheet part lying thereon and/or to move the accelerated support into an open position located outside the path of movement of the metal sheet part.

24. The method according to claim 23, wherein the rotation axis extends at a right angle to the gravitational direction.

* * * * *